US005310001A

United States Patent [19]

Burns, Sr. et al.

[11] Patent Number: 5,310,001

[45] Date of Patent: May 10, 1994

[54] METHOD OF RETRIEVING A DOWNHOLE TOOL UTILIZING NON-ROTATIONAL WORKSTRINGS

[75] Inventors: Timothy D. Burns, Sr.; Kenneth D. Caskey, both of Duncan, Okla.

[73] Assignee: Halliburton Company, Duncan, Okla.

[21] Appl. No.: 13,749

[22] Filed: Feb. 4, 1993

Related U.S. Application Data

[62] Division of Ser. No. 693,495, Apr. 30, 1991, Pat. No. 5,224,547.

[51] Int. Cl.[5] ..... E21B 23/00

[52] U.S. Cl. ..... 166/301; 166/98; 166/240; 166/377

[58] Field of Search ..... 166/301, 182, 179, 192, 166/118, 240, 377, 98, 99; 294/86.26, 86.27, 86.28, 86.29, 86.30, 86.31, 86.32, 86.33

[56] References Cited

U.S. PATENT DOCUMENTS

| | | | |
|---|---|---|---|
| 3,244,233 | 4/1966 | Villalon, Jr. | 166/123 |
| 3,638,988 | 2/1972 | Brown | 294/86.18 |
| 3,697,114 | 10/1972 | Chatard et al. | 294/86.26 |
| 3,863,974 | 2/1975 | Dinning | 294/86.3 |
| 4,545,431 | 10/1985 | Fore | 166/183 |
| 4,648,446 | 3/1987 | Fore et al. | 166/123 |
| 4,693,309 | 9/1987 | Caskey | 166/123 |

*Primary Examiner*—Terry Lee Melius

*Attorney, Agent, or Firm*—James R. Duzan; Neal R. Kennedy

[57] ABSTRACT

An apparatus for retrieving downhole devices is disclosed. The apparatus of the present invention includes a retrieving device that can be run on non-conventional workstrings such as coiled tubing, wireline, or electric line. The apparatus comprises a power mandrel, an inner sleeve mandrel slidably disposed within the power mandrel, and an overshot means. Means are provided to translate longitudinal movement of the power mandrel into rotational movement of the inner mandrel.

5 Claims, 4 Drawing Sheets

METHOD OF RETRIEVING A DOWNHOLE TOOL UTILIZING NON-ROTATIONAL WORKSTRINGS

This is a divisional of copending application Ser. No. 07/693,495, filed on Apr. 30, 1991, now U.S. Pat. No. 5,224,5470.

BACKGROUND OF THE INVENTION

1. Field of the Invention

This invention relates to an apparatus for retrieving downhole devices in a wellbore. More particularly, but not by way of limitation, the invention relates to retrieving downhole devices when the workstring utilized does not provide for a rotational movement such as when the workstring is coiled tubing, wireline, or electric line.

2. Description of the Prior Art

Wireline set, tubing retrievable packer type bridge plugs are known in the art. In oil and gas wells, it is desirable to have a bridge plug which will withstand high differential fluid pressures thereacross. In the past, these bridge plugs have been set utilizing either wireline or drill pipe workstrings. Examples of these wireline set tubing retrievable bridge plugs are found in U.S. Pat. Nos. 4,648,446 to Fore and Caskey, and 4,693,309 to Caskey, both patents being assigned to the assignee of the present invention. Both of the disclosures having been referred to are incorporated by express reference hereto.

As will be seen from these patents, the apparatus used to retrieve these packers comprises an overshot member, upper ring spring holder, lower ring spring holder, and ring spring. Furthermore, to retrieve the bridge plug in the prior art, the retrieving tool previously discussed is connected to a tubing string and lowered into the casing wellbore. A description of the procedure used to retrieve the prior art bridge plug can be found in U.S. Pat. No. 4,648,446, column 7, beginning at line 53, and continuing through column 9 line 10.

However, oil and gas operations are increasingly relying on either coiled tubing, wireline or electric line service to perform work previously done by drill pipe or production tubing. One of the reasons for increased reliance on coil tubing, electric line, and wireline is the less expensive cost and ease of operations of utilizing these methods. Also, horizontal wells are being drilled increasingly, and traditional "rigid" workstrings such as drill pipe have certain limitation, as will be understood and appreciated by those skilled in the art. However, the prior art does not provide for the retrieving of the bridge plugs or other downhole apparatus' except by utilizing a rigid workstring in which rotation can be imparted from the surface to the downhole tool.

SUMMARY OF THE INVENTION

Therefore, the retrieving tool of the present invention does not require a rigid tool string. Instead, the tool is run in the hole utilizing an apparatus such as coiled tubing, electric line, or wireline. The actual downhole bridge plug or other downhole device has been modified only to include reciprocal ratchet teeth at its upper fishing neck, otherwise the downhole packer or other downhole device remains unchanged.

The retrieving tool utilizes a power mandrel to transmit a longitudinal force downhole. An overshot means is provided to engage the retrieving tool onto the bridge plug. A means for latching on to the top of the bridge plug (or other downhole device) is provided on an inner sleeve mandrel, with the inner sleeve mandrel being slidably disposed within the power mandrel. The inner sleeve mandrel also contains means for rotating the inner sleeve mandrel within the power mandrel.

After attaching the overshot means to the plug, the following means for rotating is utilized. Specifically, the means for rotating contains a J-slot member located on the inner sleeve mandrel. A J-slot lug is provided on the power mandrel. Once a longitudinal force has been applied, by setting down weight from the surface, the lug is moved up and, transversely following the contours of the J-slot member, with the lug causing the J-slot member to rotate. This imports the rotational movement to the power mandrel via the inner sleeve mandrel.

Next, weight is slacked off from the surface which allows the lug to travel down, but this time at a different reference point in the J-slot member. At this point, the lower lug will also turn in the J-slot member of the plug. Once the appropriate distance has been slacked off, weight will again be picked up. Again the J-slot lug of the power mandrel will travel upward, and transversely following the contours of the J-slot member. This will complete rotational movement of the inner sleeve mandrel relative to the power mandrel and the upward movement will unset the plug.

In a typical operation, first, a closed valve will be placed on top of the bridge plug. Thus, in order to open the valve, the lower shoulder of the second inner sleeve mandrel will come into contact with a sliding sleeve on the valve. Downward movement of the shoulder (located on the inner sleeve mandrel) will result in opening of the valve because the shoulder pushes the valve's sliding sleeve open. As the valve is being opened, the lug on the second inner sleeve mandrel will be positioned into the J-slot portion contained on the valve means.

Finally, an overshot means is provided to guide and engage the apparatus over the downhole packer. The overshot means provides a lower housing which contains ratchet teeth. The downhole apparatus (which may be an Express Bridge Plug) to be retrieved has been modified to contain receptacle ratchet teeth. Thus, as the overshot comes into contact with the plug, the ratchet teeth will engage. This will prevent counter clockwise rotation of the overshot mandrel, but will not effect the inner sleeve mandrel or the power mandrel's ability to rotate relative to one another.

Therefore, faced with a problem of the inability to retrieve downhole apparatus such as Express Bridge Plugs when the workstring utilized is coiled tubing, wireline or electric line, the present invention allows the translating of longitudinal movement into rotational movement. One feature of the present invention is having an inner sleeve mandrel slidably disposed within a power mandrel. Defined on the inner sleeve mandrel is a J-slot member wherein upward and downward movement of the power mandrel causes rotational movement of the inner sleeve mandrel. Another feature include the lower ratchet teeth contained on the overshot means which will engage the upper plug to prevent the overshot from counter clockwise rotation. Yet another feature includes the overshot housing with spring chamber which allows a variable length between the valve opening sleeve and the lower J-slot.

An advantage of the present invention lies in the use of a workstring with a minimal outer diameter i.e.

coiled tubing, wireline or electric line. Another advantage flows from the use of a less expensive workstring. Yet another advantage is in the use of a workstring which is compatible for use in highly deviated and horizontal oil and gas wells. Still another advantage relates to the ease of operating a workstring such as coiled tubing, wireline or electric line as compared to rigid workstrings such as drill pipe or production tubing.

DESCRIPTION OF THE PREFERRED EMBODIMENT

Figure 1A:
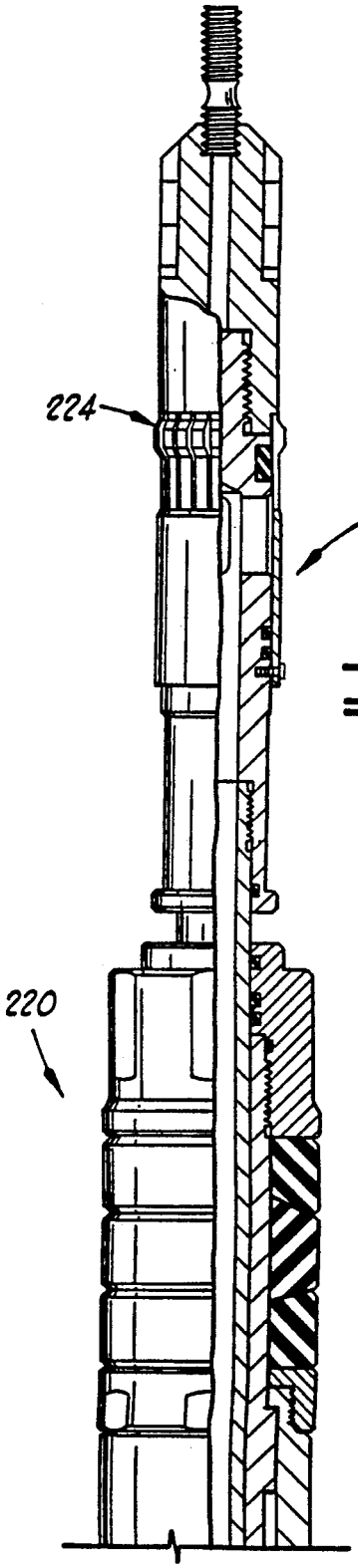
FIG. 1A PRIOR ART
FIGS. 1A and 1B are quartered sectional view of a typical downhole device such as a bridge plug used in the prior art as disclosed in U.S. Pat. No. 4,693,309.

In the description which follows, like parts are generally marked throughout the specification and drawing with the same reference numerals, respectively.

Figure 2:
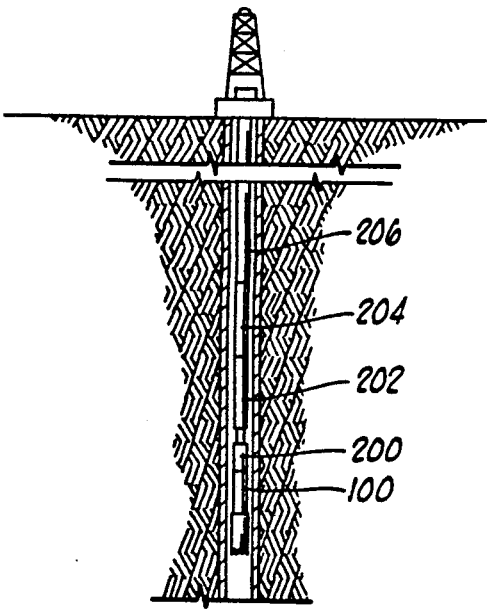
FIG. 2 is a diagram of the typical workstring to be employed with the present invention.
Figure 6A:
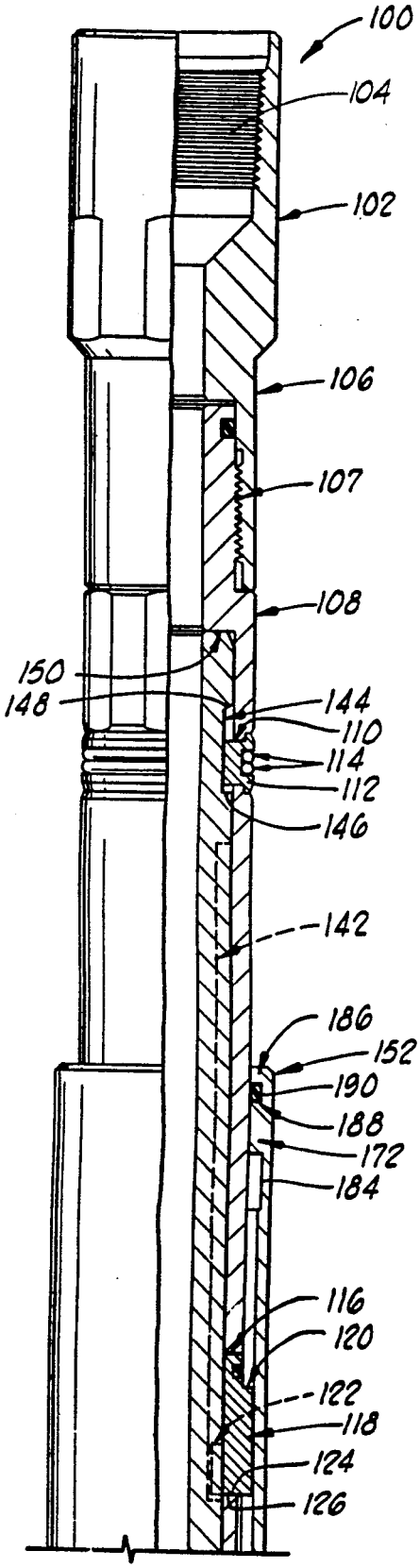
FIGS. 6A–6C are cross-sectional views of the present invention.

Referring to FIG. 6A, the retrieving tool comprises generally a power mandrel 100. The power mandrel includes a top adapter 102. The top adapter is defined by a box threaded connection 104. Referring to FIG. 2, in the preferred embodiment, the top adapter will be threadedly connected to an emergency release sub 200, with the release sub being threadedly connected to a swivel 202, and finally the swivel being threadedly connected to a jar 204.

Referring again to FIG. 6A, the outer diameter of the top adapter 102 defines a recess of smaller outside diameter 106. The bottom portion of the top adapter is a threaded box connection 107, which connects to the lower power mandrel 108, with the lower power mandrel 108 and the top adapter 102 making up the power mandrel 100. The lower power mandrel 108 contains a plurality of slotted grooves 110 about which a plurality of arcuate locking dogs 112 are placed therein. A circular spring lock 114 is placed around the plurality of locking dogs 112, to hold the locking dogs 112 in place.

Also defined on the lower power mandrel 108 is a single slot characterized at 116. Placed within this single slot 116 is a J-slot lug 118. The J-slot lug 118 contains a first shoulder at 120 and second shoulder on the opposite side of lug 118 at 122. The base 124 of the lug 118 rests against the shoulder 126 of the lower power mandrel.

Figure 3:
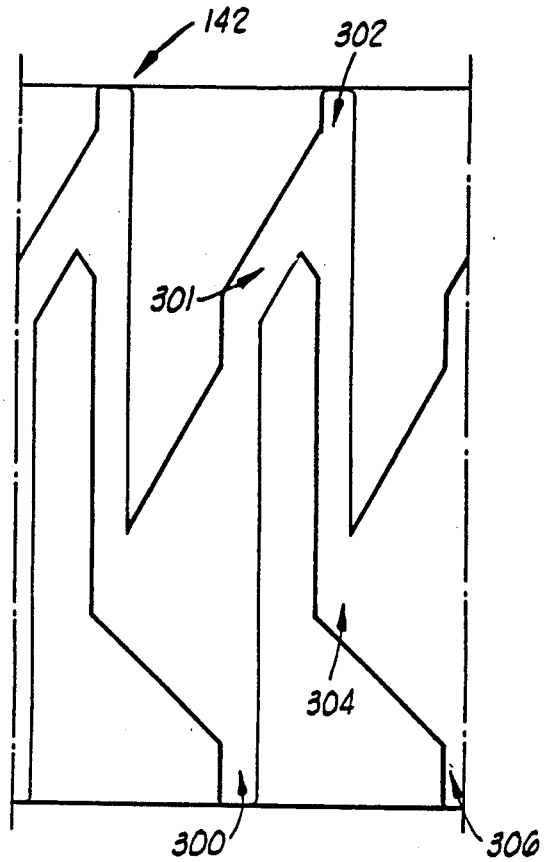
FIG. 3 is an unwrapped view of a portion of the J-slot member mandrel of the present invention which is used to retrieve a bridge plug.
Figure 4:
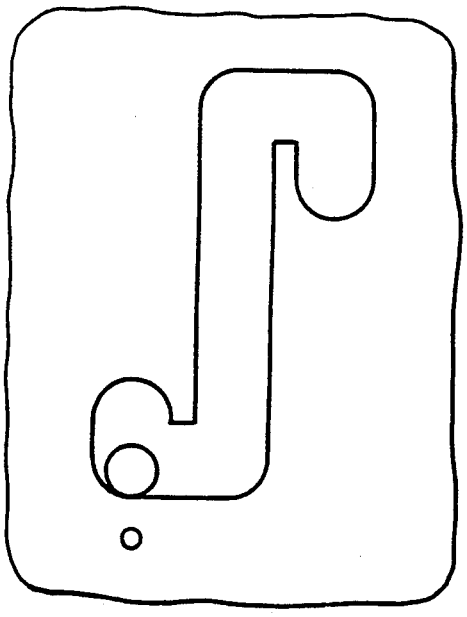
FIG. 4 PRIOR ART
FIG. 4 is an unwrapped view of a portion of the J-slot member configuration in one end of the J-slot mandrel of the prior art bridge plug which is used to release the ratchets during the retrieval of the bridge plug.
Figure 6B:
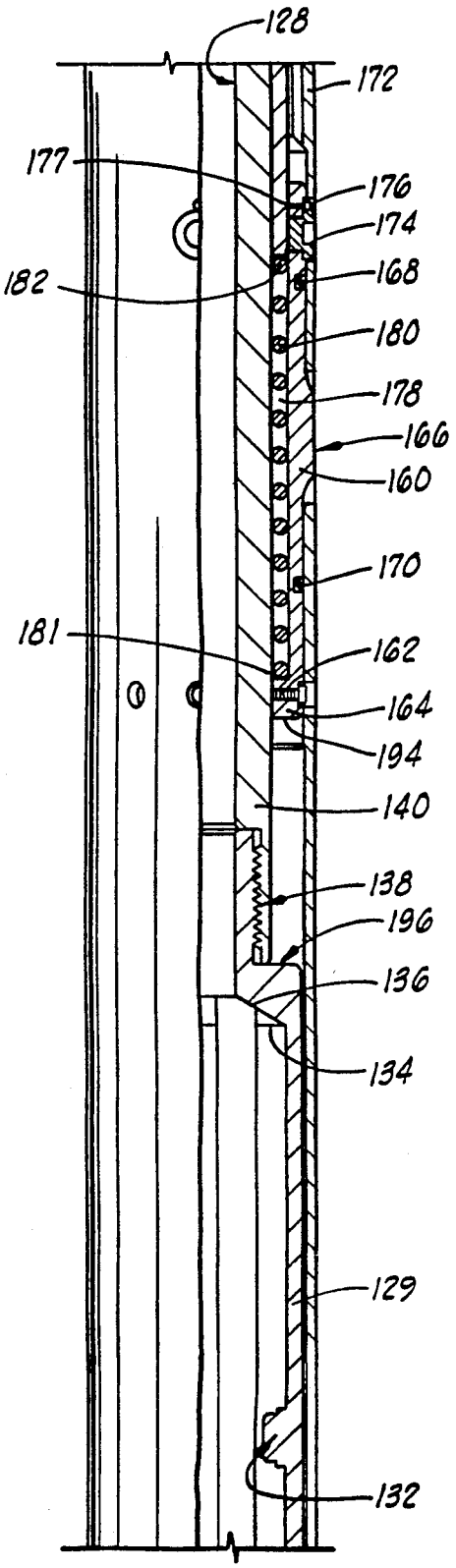
Figure 6C:
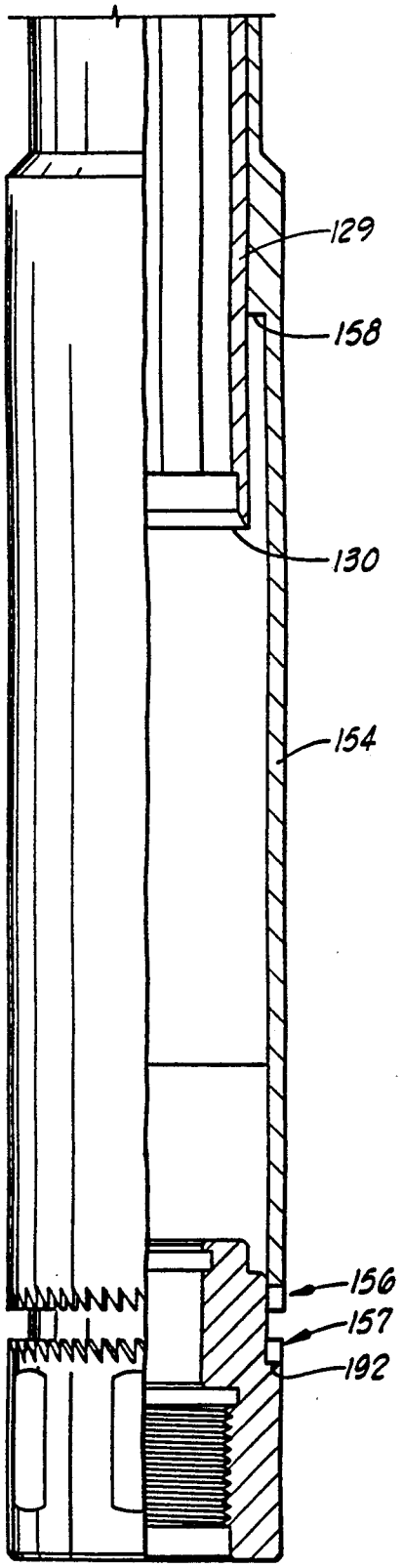

An inner sleeve mandrel 128 in FIG. 6B is slidably disposed within the power mandrel 100. Referring to FIG. 6C, the inner sleeve mandrel 128 has a first lower portion 129 which contains a first shoulder 130 which defines one end of the inner sleeve mandrel. Now referring to FIG 6B, also disposed on the inner sleeve mandrel is J-slot lug 132. The lug 132 is set on the inner sleeve mandrel 128. The bore of the inner diameter of the inner sleeve mandrel decreases relative to the center of the mandrel, forming an obtuse angle 134 at frusto-conical shoulder 136. The neck formed from the obtuse angle defines a threaded pin connection 138. The second, upper portion 148 of the inner sleeve mandrel 128 is threadedly connected to the first portion 129 of inner sleeve mandrel 128 at threaded connection 138. Referring to FIG. 3, the second portion 140 of the inner sleeve mandrel 128 has defined thereon a J-slot member of pattern 142. As previously recited, the lug at 118 is received within J-slot member 142.

Referring now to FIG. 6A, an upper neck, generally at 144, is defined on the outer periphery of the second portion 140 of the inner mandrel 128. A first shoulder 146 is defined on the inner sleeve mandrel 128 wherein the previously described locking dogs 112 rest. A second frusto-conical shoulder, 148, is formed on the upper neck 144, this second frusto-conical shoulder 148 having an obtuse angle to the base of the inner sleeve mandrel 128. A final shoulder 150, which represents one end of the inner mandrel 140, abuts the power mandrel 108 and prevents upper longitudinal movement.

The inner sleeve mandrel 128, the upper portion 140 and lower portions 129, the J-slot lugs 132, the J-slot member 142, the recessed necks 144 and associated shoulders 136 comprise the means for latching the retrieving tool to the downhole device.

Figure 1B:
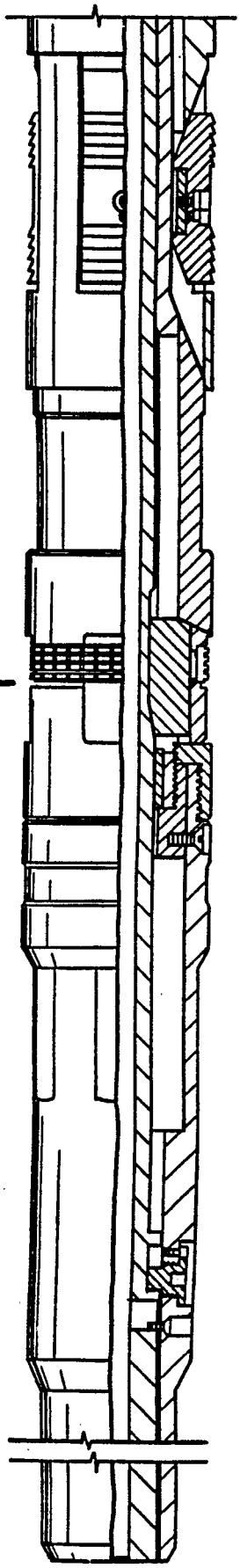
FIG. 1B PRIOR ART

The overshot means is seen generally at 152. The overshot consists of three primary members: outer sleeve 154, ratchet means 156, and center spring housing 166. Referring to FIG. 6C, the outer sleeve member 154 has defined thereon ratchet teeth at 156. The ratchet teeth 156 will engage reciprocal ratchet teeth 157 located at the top end of the bottom hole device, generally a bridge plug, as shown in FIG. 1.

Referring again to FIG. 6C, the inner diameter of the outer sleeve 154 defines a shoulder at 158. The outer sleeve 154 slidably rests about the inner sleeve mandrel 128. Please note that FIG. 6C does not show the valve 222 of the downhole device (typically, a bridge plug), seen in FIG. 1 and depicted generally at 220. Referring to the FIG. 6B, the outer sleeve 154 is rigidly connected to a center spring housing member 160. In the preferred embodiment, the outer sleeve is rigidly fixed to the center spring housing 160 by means of a hex lock screw 162. The center spring housing contains a lower member 164 containing an aperture for entry of the hex lock screw 162. The thickness of the housing generally increases to maximum thickness at the center, shown at 166. Two sealing means, which are generally 0-rings, are placed at either end of the outer peripheral of the center spring housing and are shown at 168 and 170.

The upper sleeve 172 of the overshot means 152 is rigidly secured to the center spring housing 160. In the preferred embodiment, the upper sleeve 172 is attached to the center spring housing 160 by means of a screw lock with an adjacent hex lock screw 174 and 176, respectively.

At the point of connection of the center spring housing 160 and upper sleeve 172, the center spring housing 160 rests on the power mandrel at 177. The chamber 178 defined by the annulus formed between the center housing and inner mandrel contains a helical spring 180. The spring 180 abuts the shoulder 181 of the center housing, and the lower shoulder 182 of the lower power mandrel 108. In the preferred embodiment, a helical type spring will be used.

Referring to FIG. 6A, an upper neck 184 is defined on the top of the upper sleeve 172. The upper sleeve 172 contains a ledge 186 which rests on the lower power mandrel 108 and is slidably disposed so that the lower power mandrel 108 can move relative to upper sleeve 172. A sealing means, disposed in grooves 188 of the upper sleeve leg, generally consists of an 0 ring 190.

As mentioned previously, the adapter 102 is threadedly connected to a release sub 200. The purpose of the release sub 200 is to allow a point in the workstring wherein if any of the downhole devices become lodged in the wellbore, and it is necessary to pull out the hole, the point where the workstring will be severed will be at the release sub 200. This prevents the entire workstring from becoming lodged, or stuck, in the wellbore.

Therefore, the outer sleeve member 154, containing ratchet teeth 156, center spring housing 160 rigidly connected to the outer sleeve members 154, upper sleeve housing 172, and spring 180 contained in the spring chamber 178 defined therein, comprise the overshot means 152.

OPERATION OF THE INVENTION

As previously noted, U.S. Pat. No. 4,648,446 to Fore and Caskey, as well as U.S. Pat. No. 4,693,309 to Caskey (both assigned to assignee of the present invention) describe methods to set and retrieve a retrievable bridge plug. These disclosures are incorporated by express reference herein.

Referring to FIG. 2, in order to retrieve the downhole device utilizing the present invention, the apparatus is run into the wellbore on either coiled tubing, wireline or electric line. As means of connection from the workstring 206 utilized (coiled tubing, wireline or electric line) to the apparatus of the present invention, there is utilized a jar 204, such as a Big John jar, commonly used and appreciated by those skilled in the art. Next, threadedly connected thereto, will be a swivel 202, which will allow a fixed point at one end and a rotational point at its opposite end. In other words, the swivel allows everything beneath it to rotate, relative to the workstring employed. Again, the swivel is common in the art and known to those of ordinary skill in that art.

A third member, commonly referred to as an emergency release shear sub 200, is connected to the swivel 202. The release sub 200 is pinned at its upper end to the swivel and then threadedly connected to the power mandrel 100. The shear release sub 200 is placed in the workstring in case the workstring below the shear release sub becomes stuck, allowing for the shear sub to act as a weak point to be separated and the remainder of the workstring to be brought out of the hole.

Thus, the apparatus, with a workstring 206 as previously described, is run in the hole to the desired depth where the downhole device 220 has been set. The ratchet teeth 156 on the outer sleeve 154 will fit over the top of the valve 222 and slide over the top of the downhole device 220. The ratchet teeth 156 will engage the reciprocal ratchet teeth 157 which are located on the top of the downhole device. Once engaged, the ratchet teeth means 156 will prevent counter clockwise rotation of the overshot means 152.

Simultaneously with the engagement of the ratchet teeth 156 with reciprocal ratchet teeth 157, the shoulder 130 on the inner sleeve mandrel, lower portion 129, will act against the valve ring sleeve 224, thereby opening the valve. It should be remembered that the outer sleeve housing member 154 slides over the valve 222 and engages the ratchet teeth means 157. The ratchet teeth means 156 will abut shoulder 192 of the downhole device. Downward movement of the inner sleeve mandrel 129 will be biased, however, because of the spring 180, located in the spring chamber 178.

As the shoulder at 130 opens the valve 222 of the downhole device, the lug at 132 of the inner sleeve mandrel 129 enters the J-slot member located on the valve means 222. Continued downward force on the power mandrel 100 transmits the downward force through the inner sleeve mandrel 128. As ratchet teeth means 156 and reciprocal ratchet teeth 157 abut, downward movement of outer sleeve 154 of the overshot means 152 will stop relative to the downhole device; however, the inner sleeve mandrel 128 can continue downward longitudinal travel, moving relative to the overshot means 152. As shown in FIG. 6B, the spring 180 is in compression. Normally, the spring is expanded to the full extent of the spring chamber 178, such that the shoulder 194 of the spring housing abuts shoulder 196 of the inner sleeve mandrel.

Next, the workstring is picked up i.e. upward longitudinal force is applied on the power mandrel 100. As upward force is applied the locks 112 travel upward relative to the inner sleeve mandrel 128 until locks 112 encounters chamfered shoulder 148. At this point, locks 112 will engage shoulder 148 which will impart the upward force exerted on the power mandrel to also exert upward force on the inner sleeve mandrel 128 i.e. the power mandrel and the inner sleeve mandrel will now move upwards together.

As the power mandrel 100 and inner sleeve mandrel 128 continue their upward movement, the inner sleeve mandrel lug 132 will also move up in the J-slot member of the downhole device 220. Referring to FIG. 6A, the power mandrel lug 118 is at a lower position in the J-slot member 142. With reference to the inner sleeve mandrel, once the lug 132 travels to the top portion of the J-slot member, the lug 132 will act against the J-slot member and the locking dogs 112 will slip out of the recessed shoulder 144.

Referring to FIG. 3, once locking dogs 112 have slipped out of recessed neck 144, the power mandrel lug 118 travels up to point 301. As upward longitudinal force is continued to be applied to power mandrel, the lug 118 will follow J-slot member contour. Thus, lug 118 will move to the top of J-slot member 302. This traversal causes the inner sleeve mandrel to rotate. Once at the top, the lug 118 will act against the J-slot member at 302. The operator of the workstring can recognize the position of the lug relative to the J-slot member due to the increase in the weight of the workstring. Next, weight can be slacked off and lug 118 moves down relative to the J-slot member.

Lug 118 will contact shoulder 304 in its downward movement As the workstring is slacked off (longitudinal movement downward) lug 118 will travel to 306. This traversal causes the inner sleeve mandrel to again rotate.

Thus, as the inner sleeve mandrel 128 was rotating due to the longitudinal movement of the power mandrel 100, the lug at 132 on the inner sleeve mandrel was also rotating. The rotation of the lug 132 engaged the J-slot member contained in the valve means 222 of the downhole device. An upward force, applied to the power mandrel 100 will now cause lug 132 to act against the J-slot member in the valve, and increased longitudinal movement will thereby effect a release of a downhole device 220 (Express Bridge Plug) as previously disclosed in patents '446 and '309.

Figure 5:
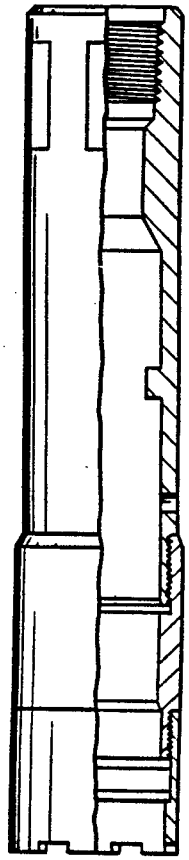
FIG. 5 PRIOR ART
FIG. 5 is a view of the prior art retrieving tool used to retrieve the bridge plug on a rigid workstring.

FIG. 5 is provided to show the prior art means to retrieve the typical downhole device (bridge plug) with a rigid workstring, as shown in FIGS. 2A-2D. For a detailed disclosure, see aforementioned patent numbers '446 and '309.

Changes and modifications in the specifically described embodiments can be carried out without departing from the scope of the invention which is intended to be limited only by the scope of the appended claims.

What is claimed is:

1. A method of retrieving a downhole tool in a wellbore comprising the steps of:

running into the wellbore with a retrieving apparatus comprising a lug on one portion thereof and a plurality of ratchet teeth on a second portion thereof;

engaging the downhole tool with said ratchet teeth and thereby preventing relative rotation between said downhole tool and said second portion of said retrieving apparatus;

positioning said lug into a J-slot member in said downhole tool; and rotating said first portion of said retrieving apparatus relative to said downhole tool to locate the lug with respect to said downhole tool.

2. The method of claim 1, further comprising the steps of:

engaging said lug within said J-slot member; and pulling on said retrieving apparatus until said downhole tool has been disengaged from said wellbore.

3. A method of rotating an inner mandrel disposed within an outer mandrel on a non-rigid workstring, said method comprising the steps of:

connecting the outer mandrel to a downhole device;

preventing rotational movement of said outer mandrel relative to said downhole device;

picking up on the workstring and thereby causing longitudinal movement of said outer mandrel relative to said inner mandrel and using a J-slot for rotating said inner mandrel relative to said outer mandrel by said longitudinal movement; and lowering the workstring and using said J-slot for providing further rotation of said inner mandrel relative to said outer mandrel.

4. A method of retrieving a downhole tool in a wellbore, said method comprising the steps of:

running a retrieving apparatus into the wellbore adjacent to the downhole tool;

engaging ratchet teeth on a portion of said retrieving apparatus with the downhole tool;

positioning a lug on an additional portion of said retrieving apparatus in a J-slot member on the downhole tool; and rotating said additional portion of said retrieving apparatus relative to said downhole tool for positioning said lug with respect to said downhole tool.

5. The method of claim 4 further comprising the steps of:

engaging said lug with said J-slot member; and pulling on said retrieving apparatus to disengage said downhole tool from said wellbore.

* * * * *